US006139373A

United States Patent [19]

Ward et al.

[11] Patent Number: 6,139,373

[45] Date of Patent: Oct. 31, 2000

[54] MULTI-PIN ELECTRICAL CONNECTORS

[75] Inventors: Terrance S. Ward; Bernard H. Hammond, both of Cordova; John T. Doyle, Collierville, all of Tenn.

[73] Assignee: Thomas & Betts International, Inc., Sparks, Nev.

[21] Appl. No.: 09/053,884

[22] Filed: Apr. 2, 1998

Related U.S. Application Data

[60] Provisional application No. 60/043,204, Apr. 8, 1997.

[51] Int. Cl.[7] ..... H01R 13/40

[52] U.S. Cl. ..... 439/733.1; 439/689

[58] Field of Search ..... 439/733.1, 80, 439/101, 108, 607, 608, 609, 610, 586, 869, 571, 567, 924, 689; 433/181

[56] References Cited

U.S. PATENT DOCUMENTS

| | | | |
|---|---|---|---|
| 2,342,552 | 2/1944 | Mallina . | |
| 3,149,898 | 9/1964 | Klumpp, Jr. . | |
| 3,456,535 | 7/1969 | Schwennesen . | |
| 3,470,529 | 9/1969 | Klumpp, Jr. . | |
| 3,473,219 | 10/1969 | Randar et al. . | |
| 3,715,943 | 2/1973 | Hirai et al. . | |
| 3,815,077 | 6/1974 | Anhalt et al. . | |
| 3,880,493 | 4/1975 | Lockhart, Jr. . | |
| 4,383,361 | 5/1983 | Kautz . | |
| 4,394,795 | 7/1983 | Goss . | |
| 4,808,125 | 2/1989 | Waters et al. . | |
| 4,907,987 | 3/1990 | Douty et al. | 439/571 |
| 4,969,258 | 11/1990 | Fisher et al. . | |
| 5,044,988 | 9/1991 | Hirayama . | |
| 5,074,030 | 12/1991 | Anderson et al. . | |
| 5,074,807 | 12/1991 | Parmer . | |
| 5,080,613 | 1/1992 | Orui et al. | 439/660 |
| 5,104,329 | 4/1992 | Brown et al. | 439/108 |
| 5,115,375 | 5/1992 | Garay . | |
| 5,117,330 | 5/1992 | Miazga . | |
| 5,127,839 | 7/1992 | Korsunsky et al. . | |
| 5,139,446 | 8/1992 | Costello et al. | 439/751 |
| 5,142,777 | 9/1992 | Boyer et al. . | |
| 5,154,634 | 10/1992 | Brown et al. . | |
| 5,163,851 | 11/1992 | Hart et al. . | |
| 5,167,531 | 12/1992 | Broschard, III et al. | 439/540 |
| 5,208,968 | 5/1993 | Camsell et al. . | |
| 5,254,016 | 10/1993 | Ganthier . | |
| 5,276,962 | 1/1994 | Harting et al. . | |
| 5,336,111 | 8/1994 | Thrush et al. . | |
| 5,419,036 | 5/1995 | Lane et al. . | |
| 5,468,154 | 11/1995 | Yip et al. . | |
| 5,468,160 | 11/1995 | Broschard, III . | |
| 5,478,257 | 12/1995 | Cachina et al. . | |
| 5,547,385 | 8/1996 | Spangler . | |
| 5,807,135 | 9/1998 | Clark | 439/567 |

*Primary Examiner*—Paula Bradley
*Assistant Examiner*—Alexander Gilman
*Attorney, Agent, or Firm*—Hoffmann & Baron, LLP

[57] ABSTRACT

An electrical connector assembly provides for connection between a mating connector and a printed circuit board. The assembly includes an elongate insulative housing having a connection face and an opposed mounting face. A plurality of elongate electrical contacts are supported within the housing. The contacts include connection ends adjacent the connection face and contact tails extending from the mounting face for insertion into through-holes of the printed circuit board. The contacts further define a securement member between the connection end and the opposed tail. The housing includes contact support members adjacent the mounting face. At least one of the contact support members is positioned at a location closer to the connection face than the other contact support members so as to position the connection end of at least one contact at a different longitudinal position than the other contacts. The contacts of the present invention may be stamped from a flat metal stamping at closer centers reducing the amount of scrap material. Furthermore, the connector may include a L-shaped connector securement clip for insertion into a mounting opening in the printed circuit board. The L-shaped securement clip includes a needle eye compliant section extending therethrough.

16 Claims, 7 Drawing Sheets

MULTI-PIN ELECTRICAL CONNECTORS

This application claims the benefit of U.S. Provisional Application No. 60/043,204, filed on Apr. 8, 1997.

FIELD OF THE INVENTION

The present invention relates generally to an electrical connector for securement to a printed circuit board. More particularly, the present invention relates to a multi-pin electrical connector having improved contact and connector configuration.

BACKGROUND OF THE INVENTION

In order to make electrical termination to a printed circuit board, the art has developed various electrical connectors which are mounted to the printed circuit board and provide connection capabilities for external components. Typical of these devices are electrical connectors having an insulative housing with plural electrical contacts supported therein. These contacts include tail portions which extend exteriorly of the insulative housing and are insertable into through holes in the printed circuit board. These contact tails may be soldered or otherwise secured to the printed circuit board to provide mechanical and electrical connection thereto. The contacts also include connection portions opposite the contact tails which are designed for connection to contacts of a mating electrical connector. Thus, these electrical connectors establish connection between the mating connector and the printed circuit board.

These printed circuit board connectors may be used for a wide variety of interconnection purposes. For instance, the printed circuit board connectors may be adapted to mate with a mating electrical connector terminating a flat ribbon cable. The printed circuit board connectors may also be adapted to terminate a connector mounted to an external component such as a disk drive in computer applications.

One technique to adapt a particular printed circuit board connector to terminate a particular mating connector is to vary the type, position and displacement of the contacts supported in the insulative housing. Variations such as, for example, contact pitch, contact configuration and number and location of contacts may render the printed board connector uniquely connectable with one type of mating connector. As an example, there exists certain mating connectors which employ what is known in the art as a "first-make last-break" feature. This feature assures that when connection between the printed circuit board connector and the mating connector is made, certain contacts such as, for example, ground contacts make electrical connection before the remaining contacts, such as the single contacts. When disconnecting the printed circuit board from the mating connector, this feature assures that the ground contacts break connection after the signal contacts break connection. Thus the contacts positioned with the insulative housing of the printed circuit board must be uniquely configured and positioned within the housing so as to provide such feature.

Furthermore, it is necessary to assure that the printed circuit board connector is securely mounted to the printed circuit board. While the contact tails make electrical connection and to some degree provide for mechanical connection to the printed circuit board, secure mechanical engagement of the connector to the printed circuit board must be assured. Such securement is provided so that the printed circuit board connector maintains its mechanical and electrical engagement with the printed circuit board during repeated mating and unmating cycles.

It is, therefore, desirable to provide a multi-contact printed circuit board connector which may be securely mechanically and electrically connected to a printed circuit board and which includes contacts specifically configured and located to provide the desired connection interface.

SUMMARY OF THE INVENTION

It is an object of the present invention to provide an improved electrical connector for securement to a printed circuit board which accommodates a multi-pin contact arrangement of specific construction, arrangement and location within the connector housing.

It is a further object of the present invention to provide a printed circuit board connector which provides both secure mechanical and electrical engagement to the printed circuit board.

It is a still further object of the present invention to provide an improved contact arrangement and method of formation which provides for the efficient formation of multiple electrical contacts for support within a printed circuit board connector housing.

In the efficient attainment of these and other objects, the present invention provides an electrical connector including an insulative housing having a connection face for connection to a mating connector and an opposed mounting face for securement to a printed board. The connector further includes a plurality of elongate electrical contacts. Each contact includes a connection end, an opposed tail and a securement member therebetween. Each contact defines a substantially identical contact expanse as measured between the connection ends and the tails. The contacts are supported within the housing such that the connection ends are positioned adjacent the connection face and the tails extend outwardly of the mounting face for securement to printed circuit board. The housing includes contact support members adjacent the mounting face where at least one of the contact support members is positioned at a location closer to the connection face than the other contact support members so as to position the connection end of at least one contact at different longitudinal position than the other contacts.

The present invention further provides that the electrical contacts may be formed from a flat metal stamping strip of conductive material. A contact pattern is stamped in the stamping strip where the contact pattern defines plural side-by-side elongate contact elements. The contact securement member of the contact elements are stamped so as to be in non-traverse alignment with an adjacent contact element. The contacts are then reconfigured so as to place the securement members in traverse alignment. Such a method of stamping contacts allows the contacts to be stamped on closer centers with less scrap material being formed.

The electrical connector further includes connector securement clips supported by the insulative housing. Each connector securement clip includes an L-shaped component having a first portion extending along the mounting face of the housing and a second portion extending at a substantially right angle therefrom for insertion into a mounting opening in the printed circuit board. The connector securement clip has a needle eye compliant section extending along both the first and second portions of the L-shaped component.

DETAILED DESCRIPTION OF THE PREFERRED EMBODIMENT

Figure 1:
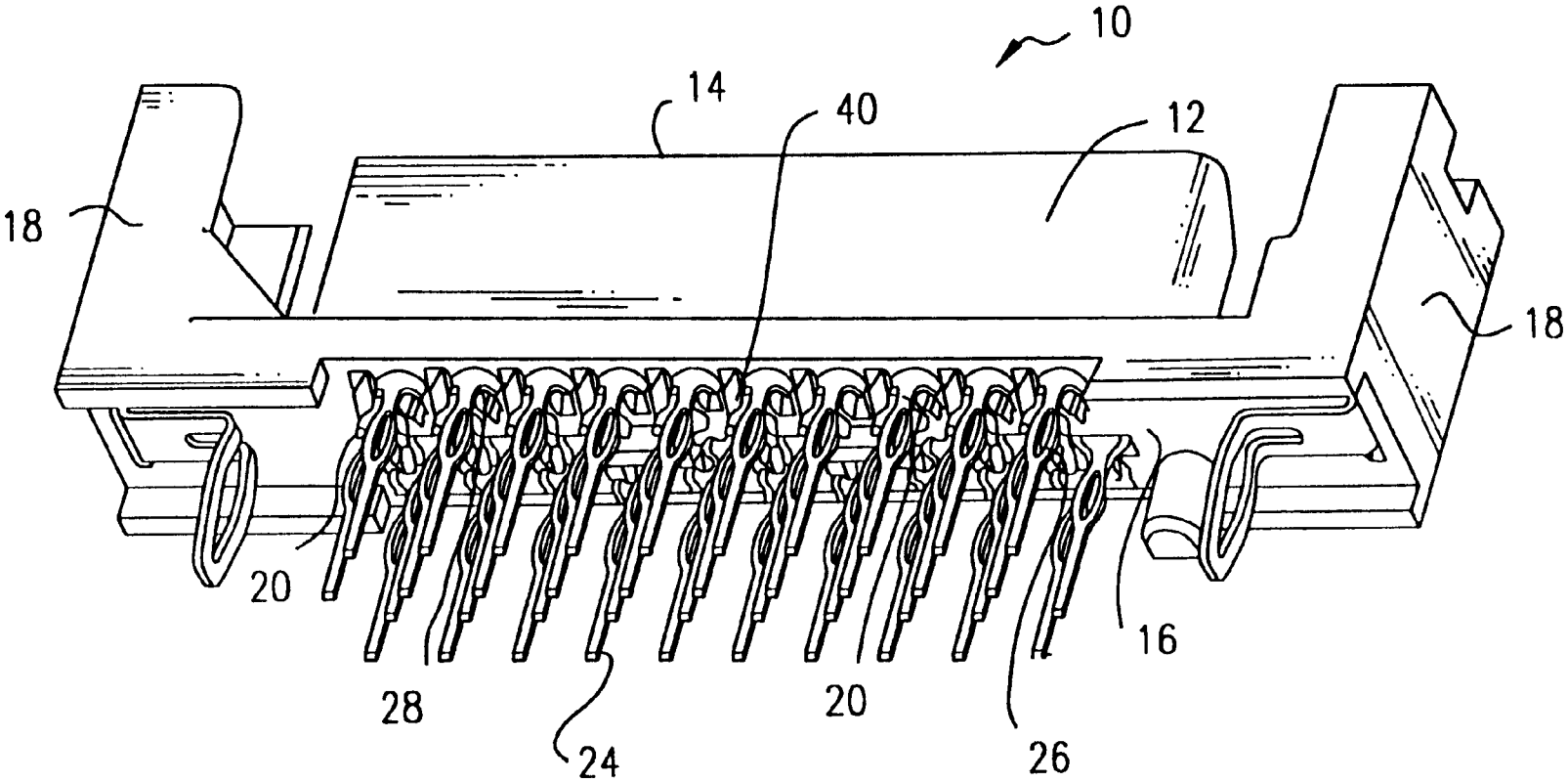
FIG. 1 is a bottom perspective showing of the printed circuit board connector of the present invention.
Figure 2:
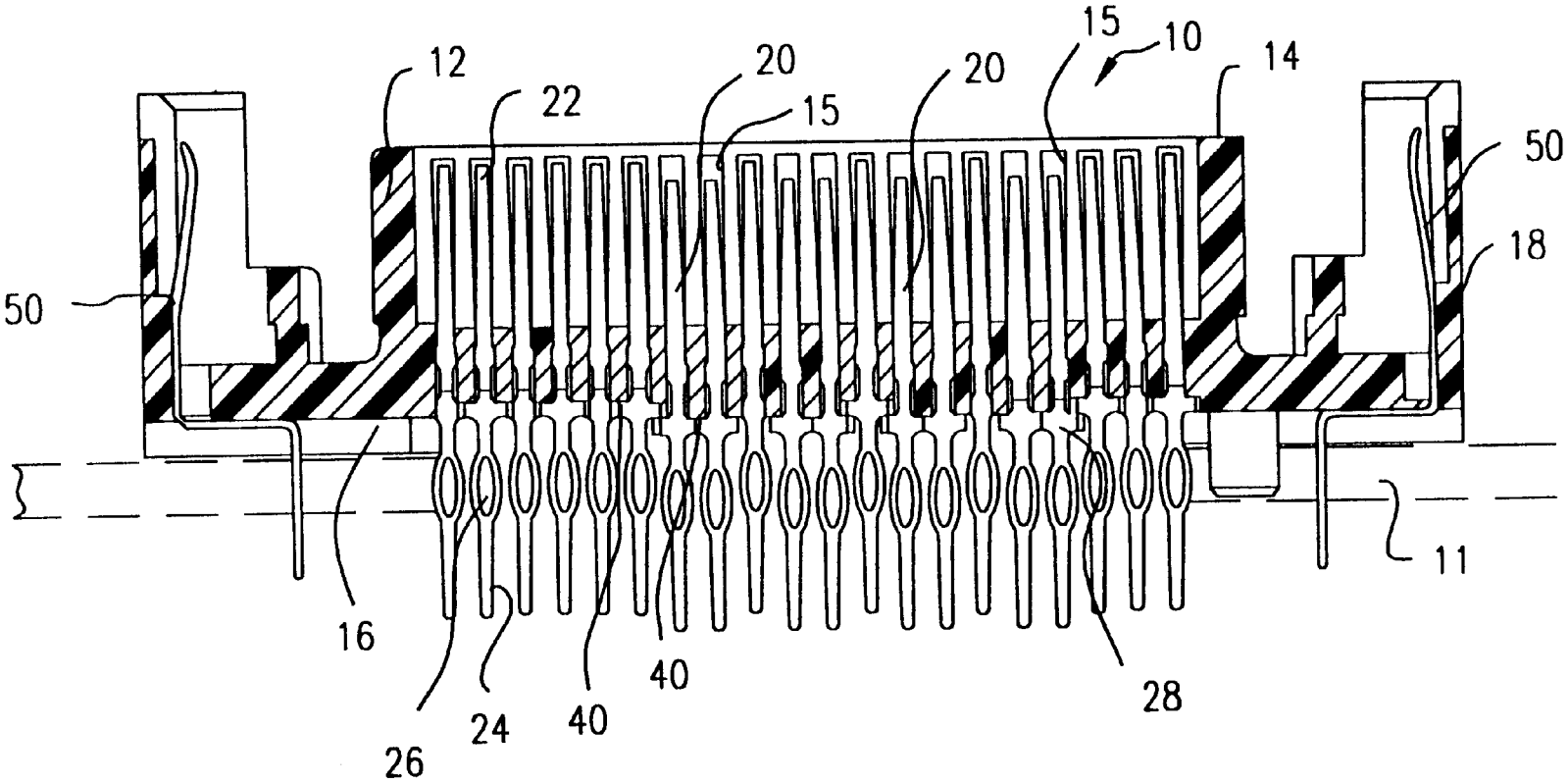
FIG. 2 is a vertical sectional showing of the printed circuit board connector of FIG. 1.
Figure 3:
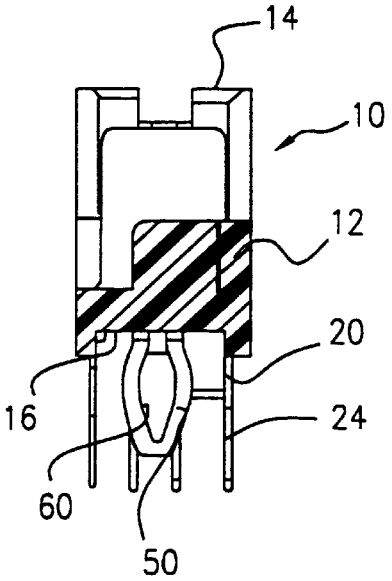
FIG. 3 is a longitudinal end view, partially in section, of the printed circuit board connector of FIG. 1.
Figure 4:
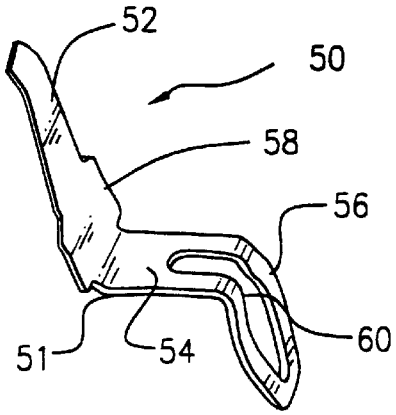
FIG. 4 is a perspective showing of a mounting clip used in accordance with the printed circuit board connector of FIG. 1.

Referring to FIGS. 1–3, an electrical connector 10 used for mounting to a printed circuit board is shown. Connector 10 includes an elongate insulative housing 12 formed of a suitable plastic material having electrically insulative properties. Housing 12 defines an upper connection face 14 and an opposed lower mounting face 16. Connection face 16 may accommodate a mating electrical connector (not shown) for mating engagement with connector 10. Mounting face 16 may be mounted onto a printed circuit board 1 1 so that connector 10 establishes electrical connection between the mating connector and the printed circuit board 11. A plurality of elongate passageways 15 are formed within housing 12. Passageways 15 extend between connection face 14 and mounting face 16 and receive and electrically isolate the contacts of connector 10. Insulative housing 12 further includes a pair of securement ears 18 at each longitudinal end thereof. Ears 18 are used to accommodate, in insertable fashion, projections from the mating connector so as to establish mechanical engagement between the mating connector and connector 10.

Referring additionally to FIGS. 5–8, insulative housing 12 supports a plurality of electrical contacts 20 individually within passageway 15. Each electrical contact 20 is an elongate member having a connection end 22 and an opposed contact tail 24. As particularly shown in FIGS. 2 and 6, connection ends 22 of contacts 20 are configured so as to mate with contacts of the mating connector and establish electrical connection therewith. The opposed contact tails 24 are configured for insertion into plated through-holes in printed circuit board 11 thereby establishing electrical connection therewith. Each contact 20 includes a stabilizing element 25 therealong. Stabilizing element 25 engages the walls of passageway 15 so as to frictionally support contact 20 within the passageways of housing 12.

As is known in the art, contact tails 24 may each include a compliant section 26 which in the present illustrative is a "needle eye" compliant contact section. The needle eye compliant section 26 is designed to provide resilient frictional engagement with the plated through-hole of printed circuit board 11 so as to establish both mechanical and electrical engagement therewith. The needle eye compliant section 26 defines an elongate aperture 26*a* therethrough which allows the compliant section 26 to resiliently engage the plated through-hole along a longitudinal segment thereof.

Each contact 20 further includes a securement member deformed intermediate of connection end 22 and contact tail 24. Securement member 28 includes a pair of oppositely directed securement shoulders 29.

Figure 6:
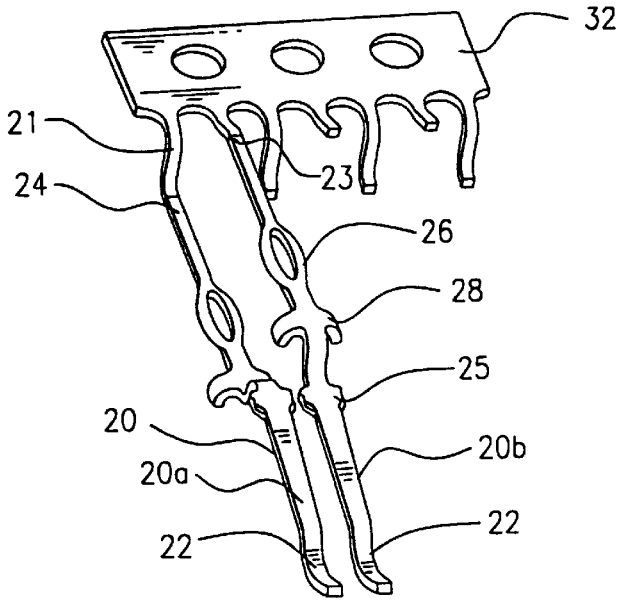
FIGS. 6, 7 and 8, show respectively, a perspective view, an end view, and a top plan view of the contact stamping of FIG. 5.
Figure 7:
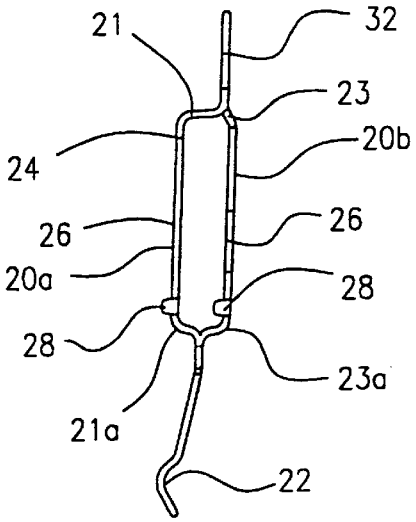
Figure 8:
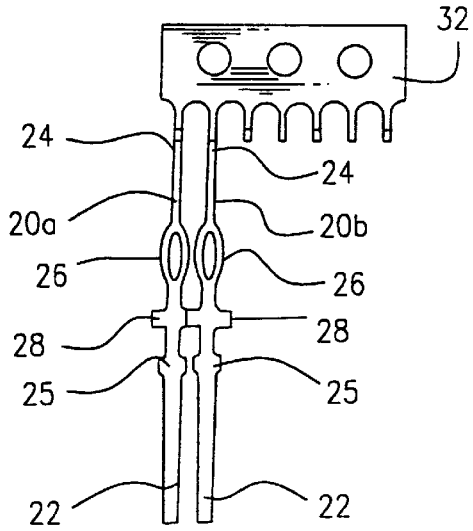
Figure 9:
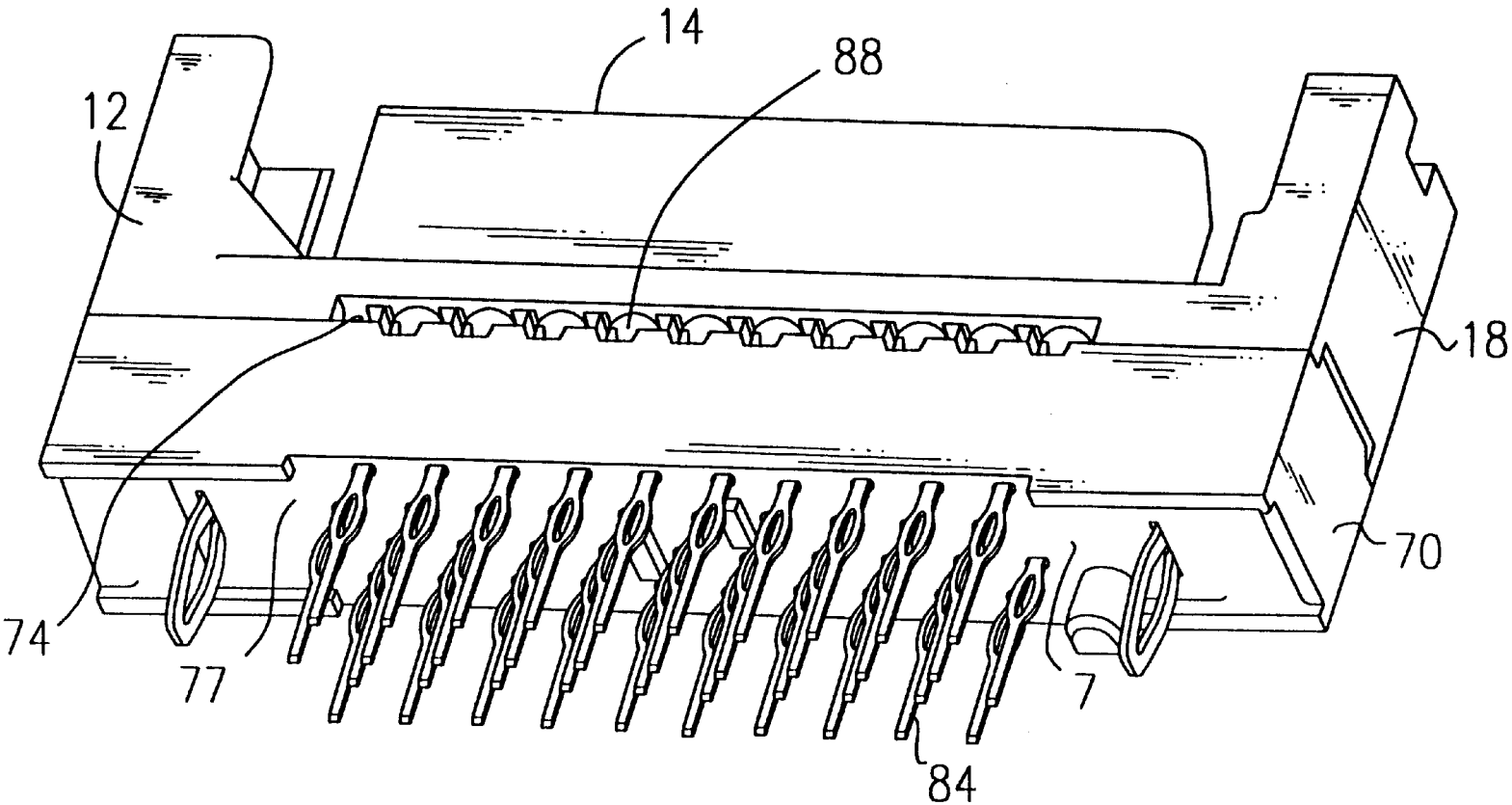
FIG. 9 is a bottom perspective showing of a further embodiment of the printed circuit board electrical connection assembly of the present invention.
Figure 10:
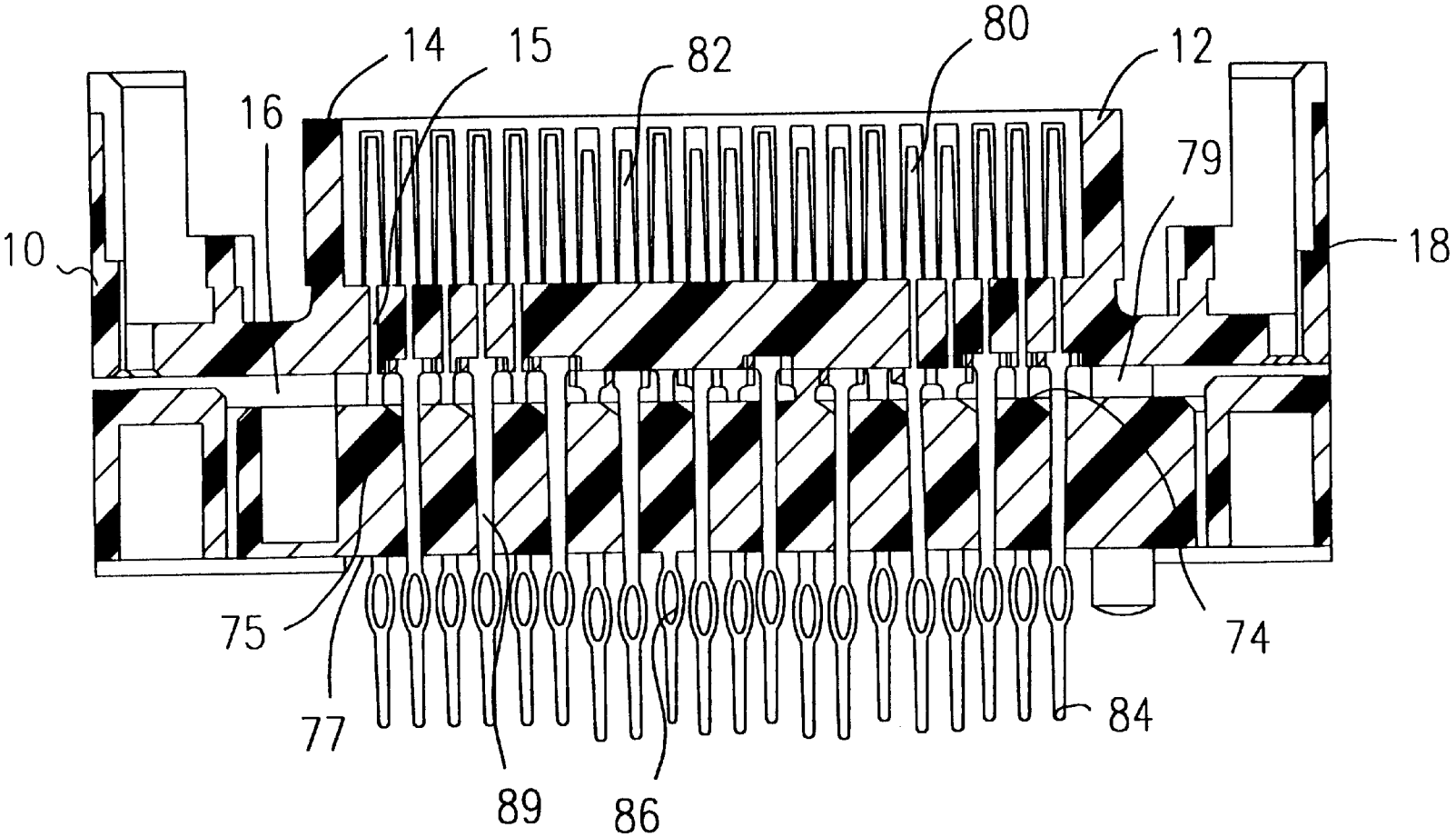
FIG. 10 is a vertical section of the connection assembly of FIG. 10.

As shown in FIGS. 6, 7 and 8, securement members 28 may be deformed out of the plane of contact 12 to have rounded shoulders 29 so as to facilitate the positional locating of contacts 20 within passageways 15, however, straight shoulders may be preferably employed. As will be described in further detail hereinbelow, securement member 28 is engageable with insulative housing 12 to positionally confine contacts 20 at predetermined positions within passageway 15.

Referring specifically to FIGS. 5–8, the formation of contacts 20 may be described. Contacts 20 are formed of a suitably electrically conductive metal from a flat metal stamping strip 30. Stamping strip 30 is stamped by a suitable tool (not shown) to define a contact pattern thereon. The contact pattern includes a plurality of side-by-side transversely spaced contacts 20 attached adjacent contact tail 24 to a carrier strip 32. The stamping may be achieved in conventional fashion where material is removed from between the desired contact pattern formation.

In prior art techniques where it is desirable to form a plurality of identical electrical contacts in side-by-side orientation, it is typically required that the stamping pattern be designed such that spacing between the stamped contacts is greater than the transverse expanse of the contact pattern. Such transverse expanse is defined by any transverse component of the contacts such as provided by securement members 28 or compliant sections 26. The utilization of such transverse components causes the pattern to include contacts which are transversely spaced apart a greater distance to accommodate such transverse component. The present invention contemplates stamping side-by-side electrical contacts having substantial transverse components in a manner where the contacts are stamped on closer spacing so as to reduce scrap and waste material, yet provide contacts with identical longitudinal expanse so as to properly locate the contacts within housing 12.

Figure 5:
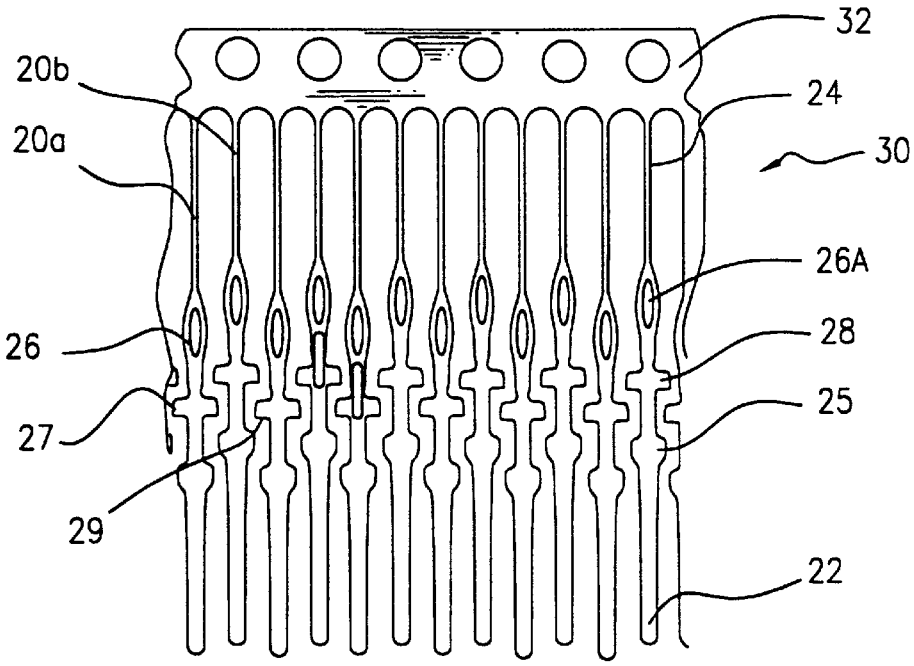
FIG. 5 is a plan view of a metal stamping used to form the contacts of the printed circuit board connector of the present invention.

As shown in FIG. 5, contacts 20 are stamped such that the transverse components of the contacts, specifically, the needle eye compliant sections 26, securement members 28 and stabilizing elements 25 are positioned at longitudinally alternating locations along the length of adjacent contacts 20. This allows contacts 20 to be stamped at closer spacings yet permits the formation of the transverse components of the contacts. For example, it can be seen that securement member 28 of one contact 20*a* transversely overlaps the location of securement member 28 of the next adjacent contact 20*b*. But for the different longitudinal formation of such element, the stamping of both securement members on such close spacings would not be possible. As may be appreciated by varying the longitudinal position of the transverse components of contacts 20 to accommodate such close spacing, it necessarily also longitudinally staggers the connection ends 22 and contact tails 24. However, as connector 10 is designed to accommodate contacts having identical longitudinal expanses (the overall distance between the ends of the contacts), the contacts 20 on carrier strip 32 are, therefore, reconfigured so as to define an identical longitudinal expanse between the contact tails 24 and the connection ends 22.

Referring specifically to FIGS. 6–7, it can be seen that each contact 20 formed from stamping strip 30 may be reconfigured. For clarity of explanation, FIGS. 6–8 show only one pair of side-by-side contacts. Contact pair 20 includes a longer contact 20*a* and a shorter contact 20*b* formed in side-by-side fashion. One contact 20*a* of each pair is reconfigured by placing a bend or a jog at a location 21 adjacent the carrier strip 32. A similar reconfiguration or jog is placed in the other contact 20*b* of the pair at a location 23 adjacent carrier strip 32. The jog of contact 20*a* of the pair which has been stamped to have the greater length is jogged to a greater degree than the other contact 20*b* of the pair. The jogging or reconfiguring of the contacts 20 is such that it brings into transverse alignment the transverse components of contacts 20. Thus, as particularly shown in FIG. 7 and 8, the contacts are reconfigured on carrier strip 32 so as to place in transverse alignment needle eye complaint section 26, securement members 28 and stabilizing elements 25. The jog in contacts 20 adjacent carrier strip 32 also places the distal ends of contact tails 24 in transverse alignment. The jogs placed in each of the side-by-side contacts adjacent carrier strip 32 are in opposite directions. Such opposite formation of the jog locations 21 and 23 places the contact tails 24 in different planes. This arrangement allows the contact tails 24 to be aligned in multiple rows in housing 12. In order to place connection ends 22 in alignment, a second jog is placed in each contact at a location 21*a* and 23*a* between securement member 28 and stabilizing elements 25. These jogs are also in opposite directions so as to place the connection ends 22 in both longitudinal and transverse alignment. Thus, in the configurations shown in FIGS. 6, 7 and 8, the contacts 20 may be severed from the carrier strip 32 at a position beyond each jog location 21 and 23. This leaves the contact tails 24 arranged in two rows with the connection ends 22 in a single row.

Referring again to FIGS. 1 and 2, the contacts 20 are arranged in insulative housing 12 such that the connections ends 22 are disposed adjacent connection face 14 and contact tails 24 extend from mounting face 16. The contacts are inserted into passageways 15 from adjacent mounting face 16 until securement members 28 engage the bottom wall of mounting face 16 which provides a mechanical stop to positionally locate the contacts therein. It is contemplated that the contacts 20 may be inserted into housing 12 while attached to carrier strip 32. Once properly located, the carrier strip may be cut from the inserted contacts.

As shown in FIGS. 1 and 2, the present invention provides a further feature by allowing the contacts to be located within housing 12 at longitudinally staggered positions. The bottom wall of mounting face 16 may include a securement surface 40 adjacent each passageway 15. The securement surfaces 40 may be positioned at longitudinally distinct locations with respect to mounting face 16. Thus, certain of the securement surfaces 40 may be located closer to connection face 14 of housing 12 than other securement surfaces. Upon insertion of contacts 20 into passageways 15, the contacts will be inserted and positionally located at different longitudinal positions. As particularly shown in FIG. 2, such arrangement positions the connections ends 22 at different locations with respect to connection face 14. It is advantageous in certain electrical applications to position certain of the connection ends of the contacts at longitudinally distinct positions. Thus, upon mating engagement with a mating connector, the contacts having connection ends 22 at a position closer to connection face 14 will make electrical engagement with the mating contacts prior to establishing connection with the other contacts. This provides a "first make last break" feature. Such a feature is particularly desirable where certain contacts are designated as ground contacts while other contacts are designated as signal contacts. In order to prevent electrical damage to the components being connected, it is often necessary to assure ground connection prior to making signal connection. The construction and arrangement of the connector of the present invention allows the connector to function in a first make last break environment.

While positioning the connection ends at different locations, the longitudinally staggered securement surfaces 40 also dispose the contact tails 24 and the compliant sections 26 at differing longitudinal positions. The particular elongate needle eye compliant section 26 formed adjacent contact tails 24 is configured so as to provide a range taking feature with respect to the through-holes of the printed circuit board. Thus, even though the compliant sections 26 are longitudinally staggered, the elongate needle eye configuration of compliant section 26 allows each compliant section to make mechanical and electrical engagement with aligned through-holes of the printed circuit board.

A further feature of the present invention is shown with respect to FIGS. 1–4. While a certain degree of mechanical securement is provided by the compliant frictional engagement of the needle eye compliant section 26 with the through-holes of the printed circuit board, additional mechanical securement between the connector 10 and the printed circuit board 11 is desired. Connector 10 provides a pair of mounting clips 50 within securement ears 18 which are engageable with a mounting aperture (not shown) in printed circuit board 11. As shown particularly in FIG. 4, mounting clip 60 is generally a planar member formed of electrically conductive spring metal. Mounting clip 50 includes an upstanding contact finger 52 extending upwardly from a planar base 54. A depending mounting tail 56 extends at a right angle to base 54 to provide an L-shaped mounting section 51. The contact finger 52 includes a pair of outwardly projecting lances 58 which are designed for frictional insertion within securement ears 18 to secure mounting clip 50 to housing 12. The base 54 of mounting clip 50 extends along mounting face 16 of housing 12 and mounting tail 56 extends downwardly in the direction of contact tails 24 of contacts 20. In order to frictionally secure mounting clip 50 in a mounting opening of the printed circuit board, the mounting clip 50 includes a needle eye compliant portion 60 formed in L-shaped section 51 through both base 54 and mounting tail 56. Needle eye compliant portion 60 extends in two planes thus providing resilient flexibility to permit the mounting tail 56 to be inserted into and frictionally engage a mounting aperture in the printed circuit board. By providing a compliant portion in two planes, the mounting clip 50 provides secure resilient engagement with the through-hole assuring secure connection therewith.

It is further contemplated that as mounting clip 50 is formed of conductive spring metal, it may also be used to make electrical engagement with a mating component of the mating connector. Such conductive engagement may establish ground connection between a plated mounting aperture into which clip 50 is inserted and grounded elements of the mating connector. In situations where mounting clip 50 establishes both mechanical and electrical engagement, it may be necessary to space the conductive base 54 from the printed circuit board so as to prevent inadvertent electrical contact with the printed elements on the printed circuit board. Thus, housing 12 provides mounting feet 62 extending from mounting face 16 adjacent securement ears 18. As shown in FIG. 2, mounting feet define a space between mounting face 16 and the printed circuit board which spaces the base 54 of mounting clip therefrom.

Referring now to FIGS. 9–14, a further feature of the present invention is shown. In certain situations where multiple electrical components are mounted to a printed circuit board, it is often necessary to place the components at closer spacings due to the need to occupy most of the available space on the printed circuit board. In situations where the mating connector designed to mate with connector 10 includes a component directly thereon, such as a disk drive, it may be difficult to place two such components in close proximity. The present invention provides the ability to place adjacent connectors 10 at different heights with respect to the printed circuit board so as to facilitate close connection of several components.

The present invention provides a connector spacer 70 which may be interposed between connector 10 and the printed circuit board. Spacer 70 is an elongate insulative member formed of suitably insulative plastic. Spacer 70 has a board mounting face 72 and opposed connector mounting face 74. Spacer 70 is attachable to the mounting face 16 of insulative housing 12 so as to space mounting face 16 above the printed circuit board. Suitable mechanical coupling members such as posts 79 may be provided between the mounting face 16 of housing 12 and the connection mounting face 74 of spacer 70 to provide mechanical attachment therebetween.

Spacer 70 includes plural passageways 75 between board mounting face 77 and connector mounting face 74. Passageways 75 of spacer 70 are alignable with passageways 15 of housing 12 so as to permit the accommodation of contacts therein. In situations where spacer 70 is employed, the contacts must be modified to accommodate the extended length. As particularly shown in FIGS. 13 and 14, contacts 80 are formed in a similar manner to contacts 20 described above. Contacts 80 include connection ends 82 for mating the electrical connection and opposed contact tails 84 for insertion into plated through-holes of the printed circuit board. Contacts 80 include a needle eye compliant section 86 adjacent contact tails 84. Contacts 80 further includes an extended length section between needle eye compliant section 86 and securement member 88 so as to traverse the distance of spacer 70. Due to the extended length of contact 80, additional stabilizer elements 89 are positioned between needle eye compliant section 86 and securement members 88. Such stabilizing elements are engageable with the walls of the passageways 75 formed within spacer 70 so as to laterally confine movement of contacts 80. This positions the contact tails 84 at precise locations for insertion into the through-holes of the printed circuit board.

Figure 11:
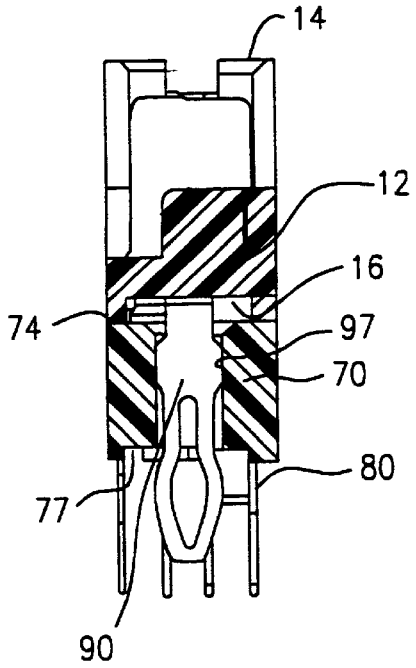
FIG. 11 is an end view, partially in section, of the connection assembly of FIG. 9.
Figure 12:
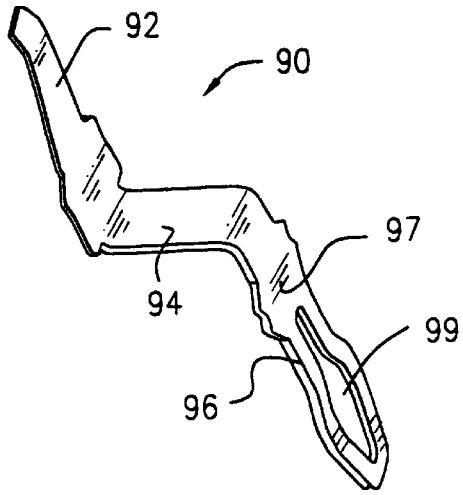
FIG. 12 is a perspective view of a mounting clip used in combination with the connection assembly of FIG. 9.
Figure 13:
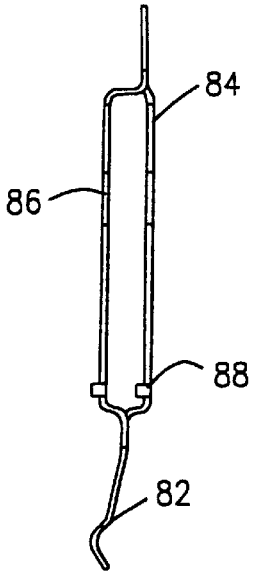
FIGS. 13 and 14 show respectively an end view and a front plant view of the contact stamping used in accordance with the connection assembly of FIG. 9.
Figure 14:
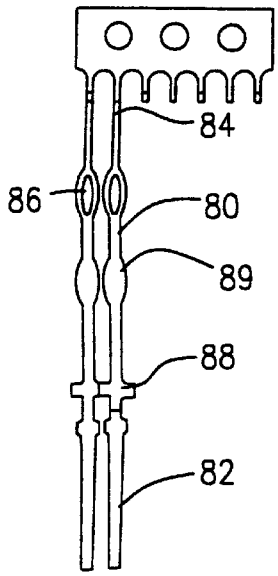

Referring to FIGS. 11 and 12, due to the position of spacer 70, a reconfigured mounting clip 90 is provided. Mounting clip 90 is substantially similar to mounting clip 70 described above having a contact finger 92 extending upwardly from a base 94. A mounting tail 96 extends at a right angle from base 54. Mounting tail 96 includes a compliant portion 99 therethrough for mechanical and/or electrical engagement with a mounting aperture of the printed circuit board. As the mounting tail is of extended length, a securement barb 97 is placed within mounting tail 96 adjacent compliant portion 99. The securement barb 97 is engageable with the walls of spacer 70 as shown in FIG. 11 to laterally confine the mounting tail therein.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An electrical connector comprising:

an elongate insulative housing having a connection face for connection to a mating connector and an opposed mounting face for securement to a printed circuit board; and a plurality of electrical contacts, substantially geometrically identical said contacts having a connection end, an opposed tail and a securement member therebetween, each said contact defining a substantially identical contact expanse measured between said connection ends and said tails with said securement members being located at a substantially identical location along said contact expanse;

said contacts being supported within said housing such that said connection ends are positioned adjacent said connection face and said tails extend outwardly of said mounting face for securement to said printed circuit board;

said housing including contact support members adjacent said mounting face, at least one of said contact support members being positioned at a location closer to connection face than the other said contact support members so as to position said connection end of at least one contact at a different longitudinal position than the other said contacts.

2. An electrical connector of claim 1 wherein said contact securement members include transversely directed contact shoulders.

3. An electrical connector of claim 2 wherein said contact support members include support surfaces for abutting engagement with said contact shoulders.

4. An electrical connector of claim 3 wherein said support surface of said at least one said support member is recessed from said support surfaces of said other contact support members with respect to said mounting face of said housing.

5. An electrical connector of claim 1 wherein each said contact further includes a board mounting element adjacent said tail, said board mounting element being frictionally insertable into a through-hole in said printed circuit board.

6. An electrical connector of claim 5 wherein said board mounting element of said at least one contact is positioned at a different longitudinal position than said board mounting element of said other said contacts.

7. An electrical connector of claim 6 wherein said board mounting element of each said contact has a longitudinal expanse of sufficient length to as to frictionally engage said printed circuit board through-hole for both said at least one contact and said other contacts.

8. An electrical connector comprising:

an elongate insulative housing having a connection face for connection to a mating connector and an opposed mounting face for mounting to a printed circuit board;

a plurality of electrical contacts supported in said housing, said contacts having a connection end and an opposed tail extending from said mounting face for insertion into through-holes in said printed circuit board;

connector securement clips supported by said housing, each said connector securement clip including an L-shaped component having a first portion extending along said mounting face of said housing and a second portion extending at substantially a right angle therefrom for insertion into a mounting opening in said printed circuit board, said connector securement clip having a needle-eye compliant section formed in both said first and second portions of said L-shaped component.

9. An electrical connector claim 8 wherein said needle eye compliant section has a longitudinal and transverse dimension and wherein said longitudinal dimension substantially exceeds said transverse dimension.

10. An electrical connector of claim 8 wherein said connector securement clip includes an upstanding connection extent extending towards said connection face.

11. An electrical connector of claim 10 wherein said connector securement clip is electrically conductive for establishing electrical connection between said printed circuit board and mating connector.

12. An electrical connector of claim 8 wherein said insulative housing includes housing feet extending from said mounting surface as to space said mounting surface above said printed circuit board so as to position said first portion of said L-shaped component off of said printed circuit board.

13. An electrical connection of claim 12 wherein said connector securement clips are located at opposed ends of said elongate housing and said housing feet are located thereadjacent.

14. An electrical connector assembly for establishing electrical connection therebetween a mating electrical connector and plated through-hole of a printed circuit board comprising:

an elongate insulative housing, said housing having a connection face for connection with said mating electrical connector and a mounting face for securement on said printed circuit board;

plural elongate conductive contacts, geometrically identical said contacts each including a connection extent supported at said connection face, an opposed contact tail extending from said mounting face for insertion into said through-holes of said printed circuit board and an intermediate securement member for positionally securing said contacts within said insulative housing; and said insulative housing including engagement surfaces for accommodating said securement members at differing positions within said housing so as to dispose said connection extents of said contacts at differing positions.

15. An electrical connector of claim 14 wherein said contact tails include compliant engagement elements adjacent an end thereof, said compliant engagement elements being insertable into said plated through-holes of said printed circuit board so as to establish electrical connection therebetween.

16. An electrical connector of claim 15 wherein said compliant engagement elements have sufficient longitudinal expanse so as to provide said engagement with said through-holes at said differing positions.

* * * * *

UNITED STATES PATENT AND TRADEMARK OFFICE

CERTIFICATE OF CORRECTION

PATENT NO. : 6,139,373
DATED : October 31, 2000
INVENTOR(S) : Ward et al.

It is certified that error appears in the above-identified patent and that said Letters Patent is hereby corrected as shown below:

Column 3,
Lines 37 and 38, delete "onto a printed circuit board 11 so that..."; the patent should read -- onto a printed circuit board 11 so that ... --. (no split of the 11)

Column 5,
Lines 20, delete "eye complaint section 26"; the patent should read -- eye complaint section 26. --.

Column 9,
Line 5, delete "and second portions..."; the patent should read -- and said second portions... --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*